US008495898B2

(12) United States Patent
Gokcebay

(10) Patent No.: US 8,495,898 B2
(45) Date of Patent: Jul. 30, 2013

(54) CAM LOCK WITH RETRACTABLE BOLT

(75) Inventor: Asil T. Gokcebay, Petaluma, CA (US)

(73) Assignee: Security People, Inc., Petaluma, CA (US)

( * ) Notice: Subject to any disclaimer, the term of this patent is extended or adjusted under 35 U.S.C. 154(b) by 1302 days.

(21) Appl. No.: 11/809,172

(22) Filed: May 30, 2007

(65) Prior Publication Data

US 2007/0277571 A1 Dec. 6, 2007

Related U.S. Application Data

(60) Provisional application No. 60/810,195, filed on May 31, 2006.

(51) Int. Cl.
*E05B 49/00* (2006.01)

(52) U.S. Cl.
USPC ..... 70/214; 70/78; 70/278.1

(58) Field of Classification Search
USPC ..... 70/78, 278.1, 127, 447, 91, 214; 292/197, 292/257, 194, 195, 198
See application file for complete search history.

(56) References Cited

U.S. PATENT DOCUMENTS

| | | | | |
|---|---|---|---|---|
| 2,046,630 | A | | 7/1936 | Jacobi |
| 3,455,127 | A | | 7/1969 | Simon |
| 3,753,164 | A | | 8/1973 | DeVries |
| 3,754,164 | A | | 8/1973 | Zorzy |
| 3,754,213 | A | | 8/1973 | Morroni et al. |
| 3,831,065 | A | | 8/1974 | Martin et al. |
| 3,878,511 | A | | 4/1975 | Wagner |
| 4,243,256 | A | | 1/1981 | Frydrych |
| 4,495,540 | A | | 1/1985 | Remington et al. |
| 4,568,998 | A | | 2/1986 | Kristy |
| 4,665,397 | A | | 5/1987 | Pinnow |
| 4,748,833 | A | * | 6/1988 | Nagasawa ..... 70/214 |
| 4,887,445 | A | | 12/1989 | Beatty |
| 4,901,545 | A | * | 2/1990 | Bacon et al. ..... 70/278.3 |
| 4,931,789 | A | | 6/1990 | Pinnow |
| 4,956,984 | A | * | 9/1990 | Chi-Cheng ..... 70/277 |
| 4,967,305 | A | | 10/1990 | Murrer et al. |
| 5,020,345 | A | | 6/1991 | Gartner et al. |
| 5,021,776 | A | | 6/1991 | Anderson et al. |
| 5,033,282 | A | | 7/1991 | Gartner et al. |
| 5,153,561 | A | | 10/1992 | Johnson |
| 5,223,829 | A | | 6/1993 | Watabe |
| 5,321,963 | A | | 6/1994 | Goldman |
| 5,373,718 | A | | 12/1994 | Schwerdt et al. |
| 5,461,218 | A | | 10/1995 | Castleman et al. |
| 5,564,294 | A | | 10/1996 | Chen |
| 5,845,523 | A | | 12/1998 | Butterweck et al. |
| 5,886,644 | A | | 3/1999 | Keskin et al. |
| 5,894,277 | A | | 4/1999 | Keskin et al. |

(Continued)

*Primary Examiner* — Kristina Fulton
(74) *Attorney, Agent, or Firm* — Thomas M. Freiburger

(57) ABSTRACT

A cam lock for cabinets, drawers, drug cabinets, credenzas, sliding doors, lockers, mail boxes and other door type applications is compact in size, fits an existing cam lock opening and provides electronic access via a keypad or other electronic access. Using batteries, such as AAA size batteries or smaller, the lock has electronics that release a lock turn knob or handle when the correct code is entered. Preferably a set of electronic contacts is included at an accessible position on the lock housing to allow both master access and power jumping with a common manager's implement, for situations of lost codes and/or battery failure. In a particular embodiment the lock is long, narrow and low in profile so as to fit on the margin of a steel or wood file cabinet, compatible with the cam lock opening already provided.

39 Claims, 15 Drawing Sheets

U.S. PATENT DOCUMENTS 6,089,058 A * 7/2000 Elpern et al. ..... 70/279.1
6,116,066 A 9/2000 Gartner et al.
6,209,367 B1 * 4/2001 Hyatt et al. ..... 70/278.2
6,331,812 B1 12/2001 Dawalibi
6,347,486 B1 2/2002 Badillet
6,384,711 B1 * 5/2002 Cregger et al. ..... 340/5.65
6,655,180 B2 12/2003 Gokcebay et al.
6,708,538 B1 * 3/2004 Walby ..... 70/285
6,791,450 B2 9/2004 Gokcebay et al.
6,989,732 B2 1/2006 Fisher
D520,340 S * 5/2006 Freck ..... D8/343
7,336,150 B2 * 2/2008 Gokcebay et al. ..... 340/5.54
7,516,633 B1 * 4/2009 Chang ..... 70/472
2003/0024288 A1 2/2003 Gokcebay et al.
2005/0179517 A1 * 8/2005 Harms et al. ..... 340/5.9
2006/0076385 A1 4/2006 Etter et al.
2006/0150694 A1 * 7/2006 Frolov et al. ..... 70/277
2007/0056339 A1 3/2007 Irgens et al.
2007/0090921 A1 4/2007 Fisher
2007/0169525 A1 * 7/2007 Chang ..... 70/472
2007/0277571 A1 12/2007 Gokcebay

* cited by examiner

CAM LOCK WITH RETRACTABLE BOLT

This application claims benefit from provisional application Ser. No. 60/810,195, filed May 31, 2006.

BACKGROUND OF THE INVENTION

This invention concerns locks for cabinets, lockers, drawers, access panels and similar situations. Specifically the invention embraces an electronic cam lock that fits standard cam lock openings.

Metal and wood file cabinets, desk and cabinet drawers, locker doors, access panels and doors, mail boxes, dispensers and other secure situations often utilize relatively simple lock mechanisms known as cam locks. Such cam locks may or may not involve a camming action. In some cases they move other mechanisms that are engaged with the door or drawer of the cabinet or engaged with other mechanisms that are linked to the door and drawer of the cabinet or multiple doors or drawers of the cabinet. In one of the simplest forms, a cam lock on a cabinet door typically fits in a ¾ inch diameter D-shaped or double D-shaped hole and, at the back side of the cam lock cylinder unit, has a metal blade or arm called a cam that rotates when the key is turned, from a position disengaged from surrounding cabinet hardware to a position of engagement in a slot or behind a ledge of the surrounding cabinet hardware. Other locks, such as those for desk drawers, commonly referred as cabinet locks, involve a camming type action as the key and plug are rotated. The rotation causes a cam or nipple to move a deadbolt linearly to a locking or unlocking position or in the case of a spring loaded latch or deadlatch the rotation causes the cam or nipple to move a latch or deadlatch to unlocking position and removing the key keeps the latch or deadlatch in the extended locked position.

Metal filing cabinets often utilize cam locks, or a variation known as a plunger type lock in which a spring loaded plunger/lock cylinder located in the top horizontal margin of the cabinet, when pushed in, will lock all drawers. The use of a key releases the spring plunger to return to the outward position and unlock the drawers.

Locker and cabinet locks have included electronic locking devices, some of which utilized keypads and some of which utilized buttons or other ID or non-volatile memory devices which work on contact to release the lock. See, for example, U.S. Pat. Nos. 5,894,277, 5,886,644, 6,655,180 and 6,791,450. The disclosures of all of these patents are incorporated herein by reference.

There is a need for a relatively simple, easily used, reliable and compact electronic lock, preferably a keypad lock but optionally operable by an electronic key, or both, for situations in which typically cam, plunger and cabinet locks were employed, and capable of fitting in a standard opening or bore of a standard cam, plunger or cabinet lock cylinder in a cabinet, door, access panel, mail box, dispenser, etc. and alternatively capable of fitting in a standard shell of a standard cam, plunger or cabinet lock cylinder in a cabinet, door, access panel, mail box, dispenser, etc. This is an objective of the current invention described below.

SUMMARY OF THE INVENTION

The invention addresses these needs with a low profile and very compact electronic lock that, in one application, fits in the top one inch horizontal margin of a steel file cabinet. The compact electronic locking device in one embodiment has a knob or handle that can rotate the cam lock cylinder plug when such manual rotation is permitted by the lock electronics. A keypad for entry of a code preferably is included, and the code in preferred embodiments can be either permanently set to a reprogrammable code, or set in each case by a temporary user, who can then input the same code to lock and unlock the lock, this feature depending on circumstances and function desired.

In one preferred embodiment particularly adapted for a file cabinet, the locking device is less than one inch in height, about three inches to five inches in length and about ⅜ to ¾ inch in depth, more preferably no more than about ⅝ inch or less in depth, as to the housing of the device. A cam locking device of this size will fit unobtrusively on the surface of the horizontal top margin area of a steel file cabinet. The housing may contain several small battery cells, such as two AAA batteries, or even smaller coin cell or button-type batteries for further reduction of housing size. From the back of the housing extends the cam lock cylinder unit of conventional cam lock size, and with a length to fit the application, i.e. the depth of material and configuration where mounted. The rear-extending cylinder unit preferably has an external thread, and a nut or threaded ring is tightened down to firmly retain the cylinder and housing in place. Since the cam lock opening in the cabinet or door or panel will typically be the conventional D-shaped opening or double D-shaped opening, the housing is fixed in place against rotation by this configuration. However, another fastening location(s) may be included, such as a machine screw assembled from the back and through a hole in the drawer or panel, engaging in a threaded hole provided in the housing, or screw posts extending from the back of the housing. This threaded hole or screw post is preferably is at an opposite end of the housing from the location of the cylinder and turning knob or handle. There may be more than one threaded hole or screw post depending on the mounting preferences. In an alternative configuration, the housing back can simply have a nipple that extends in a hole formed in the cabinet, drawer or door, or a hook-shaped element that extends from the back of the housing and engages firmly in the hole, particularly for relatively thin metal cabinets.

It is an important feature of the invention that the electronic cam lock device be compact and relatively simple, at least as to mechanical elements, and without any electronics or housing required at the back side of the door or panel. Essentially the only element at the back side of the door, drawer or panel is the rear-extending cam lock cylinder unit itself, with attached cam positioned to engage with a ledge or slot or other hardware to retain the door(s) or panel locked.

In one preferred form, the invention is embodied in a cam lock for a door, cabinet or drawer and includes a compact housing containing electronics and having a keypad and electronic key receptacle for entry of codes by a user, a cam cylinder unit extending from a back side of the housing, in a standard cam lock size adapted to fit through a standard cam lock opening in a cabinet or door for extending therethrough, and with a knob or handle on the housing for operating the cam lock manually when permitted by the electronics. A battery compartment in the housing, accessible from the front of the cabinet, contains one or more battery cells for operating the electronics.

In another preferred form, the invention is embodied in a cam lock for a door, cabinet or drawer and includes a compact housing containing electronics and having a keypad and electronic key receptacle for entry of codes by a user, a plug of the cam, plunger or cabinet lock cylinder unit extending from a back side of the housing that matches the size and shape of the cam lock shell already mounted on the door, cabinet or drawer, and with a knob or handle on the housing for operating the cam lock manually when permitted by the electronics.

Again, a battery compartment in the housing, accessible from the front of the cabinet, contains one or more battery cells for operating the electronics.

In another preferred form, the invention is embodied in a cam lock for a door, cabinet or drawer and includes a compact housing containing electronics and having a keypad and electronic key receptacle for entry of codes by a user, a special shaped driver unit extending from a back side of the housing that matches an opening on the plug of the cam cabinet or drawer, a lock shell already mounted on the door, and with a knob or handle on the housing for operating the cam lock manually when permitted by the electronics. Again, a battery compartment in the housing, accessible from the front of the cabinet, contains one or more battery cells for operating the electronics.

It is therefore among the objects of the invention to improve over prior cam and cabinet locks, with an electronic cam lock that can be retrofitted to existing cam lock and cabinet lock openings in doors, drawers, access panels, mail boxes, dispensers, etc. as well as provide an improved locking solution for new applications wherein the internal locking systems for locking multiple points are configured to receive a cam, plunger or cabinet lock. The device is relatively simple, compact and unobtrusive. These and other objects, advantages and features of the invention will be apparent from the following description of preferred embodiments, considered along with the accompanying drawings.

DESCRIPTION OF PREFERRED EMBODIMENTS

Figure 1:
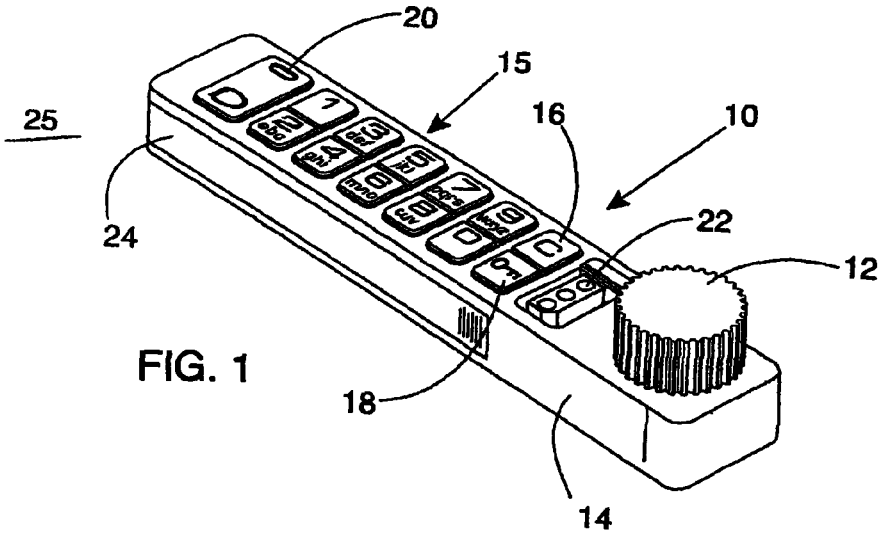
FIG. 1 is a perspective view showing an electronic cam lock device of the invention.

FIG. 1 shows an electronic cam lock 10, in a preferred form of a keypad cam lock, with a rotatable knob or handle 12 extending from a housing 14. A keypad 15 is exposed at the front of the housing to allow entry of a code, using the usual numerical digits 1 to 0 and/or letters of the alphabet, as illustrated. The keypad preferably includes a "clear" button 16 and an "enter" button 18, the latter shown with a key symbol in the drawing. The lock can be programmed such that the enter button is pushed as the last button in all code entries, thus enabling different numbers of digits for different purposes, as well as some other functions. A status LED is included at 20; this can show locked/unlocked states as well as battery status.

At 22 is shown a recess or connection with a plurality of electrical contacts, preferably three as shown. This can be for several purposes, including providing "jump" power in the event of battery failure, and use of an electronic master key for entry of a master code by contact with this connection, when a key code to which the device is set has been forgotten or lost. As in copending application Ser. No. 11/084,064, which is incorporated herein by reference, this set of contacts 22 can be connected to receive both jump power and a master code simultaneously.

Batteries are contained within the housing 14. In the embodiment shown, a slide door 24 connects with the housing to close a battery compartment which may be, for example, for two AAA battery cells. The slide door 24 may be locked against sliding whenever the cam lock device is in the locked configuration, such as by a slide pin driven by turning of the cylinder plug. This prevents unauthorized removal of batteries or tampering with the interior of the electronic lock. The door 24 may be hinged rather than slidable. The unauthorized opening may also be prevented by incorporating a single or multi-point press-to-release lock that requires a special tool for opening the battery compartment.

In FIG. 1 the lock device 10 is shown as secured on a surface or panel 25. The word "panel" is sometimes used herein and in the claims to refer to the component or surface to which the lock is secured, whether the panel is a drawer front, or margin area above, below or to the side of the drawer front, a cabinet door or margin, an access panel or adjacent structure, etc.

Figure 5:
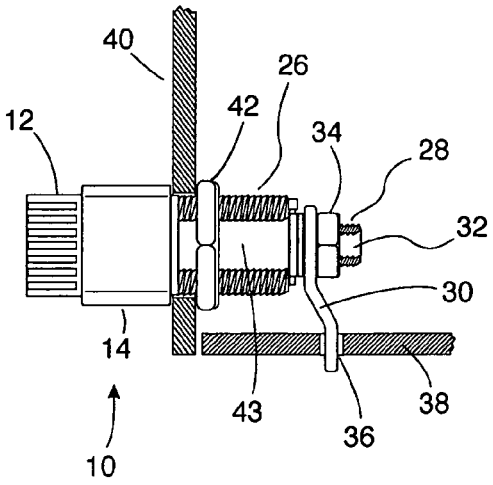
FIG. 5 is a view similar to FIG. 4, but showing the device in a locked position for a drawer, panel or door.
Figure 4:
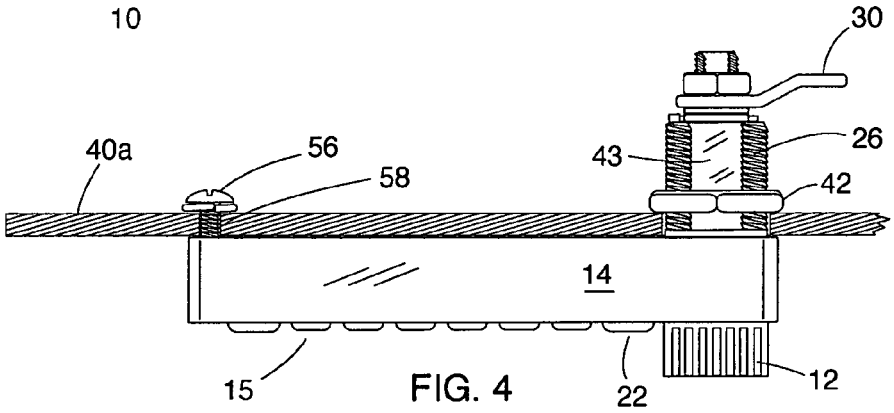
FIG. 4 is a sectional plan view showing the electronic cam lock device as installed, in one preferred manner of installation, on a cabinet or door.
Figure 3:
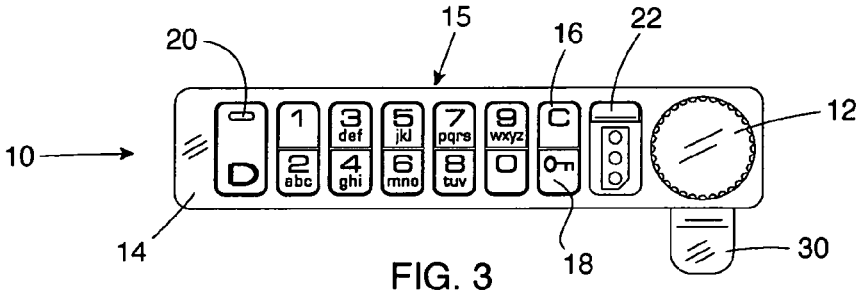
FIG. 3 is an elevation view showing the front of the device.

FIG. 3 is a frontal view of the lock device, and FIGS. 4 and 5 show that the handle or knob 12 connects directly with a cam lock cylinder unit 26, and specifically the handle 12 turns with a movable member, e.g. rotatable bolt or core 28 which rotates within the fixed cylinder unit 26 when permitted by the electronics. FIG. 5 is an end view of the lock device, generally as seen from the right side of FIG. 1 or FIG. 3 and showing one example of latching. Note that the cylinder unit's bolt or core 28 can be extended as needed, such as for a wood drawer, panel, etc.

Figure 23:
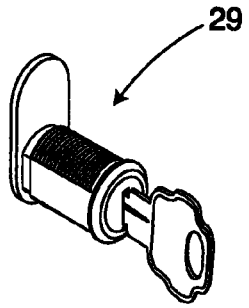
FIG. 23 (PRIOR ART)
FIG. 23 shows a typical prior art mechanical key-operated cam lock.

FIG. 23 shows a typical, simple prior art cam lock 29, of a type which can be replaced by the electronic cam lock unit 10.

The rotatable bolt 28 of the cam lock cylinder unit 26 (FIGS. 3-5) is shown fixed to a metal arm or cam 30 as this actuator is typically called. The cam is secured on the bolt or rotatable member 28 via a flat 32 on the bolt and a corresponding hole in the cam (hole not shown), so that the cam is fixed against relative rotation on the bolt. Further, the bolt is threaded and a nut 34 is tightened down for retention.

Figure 2:
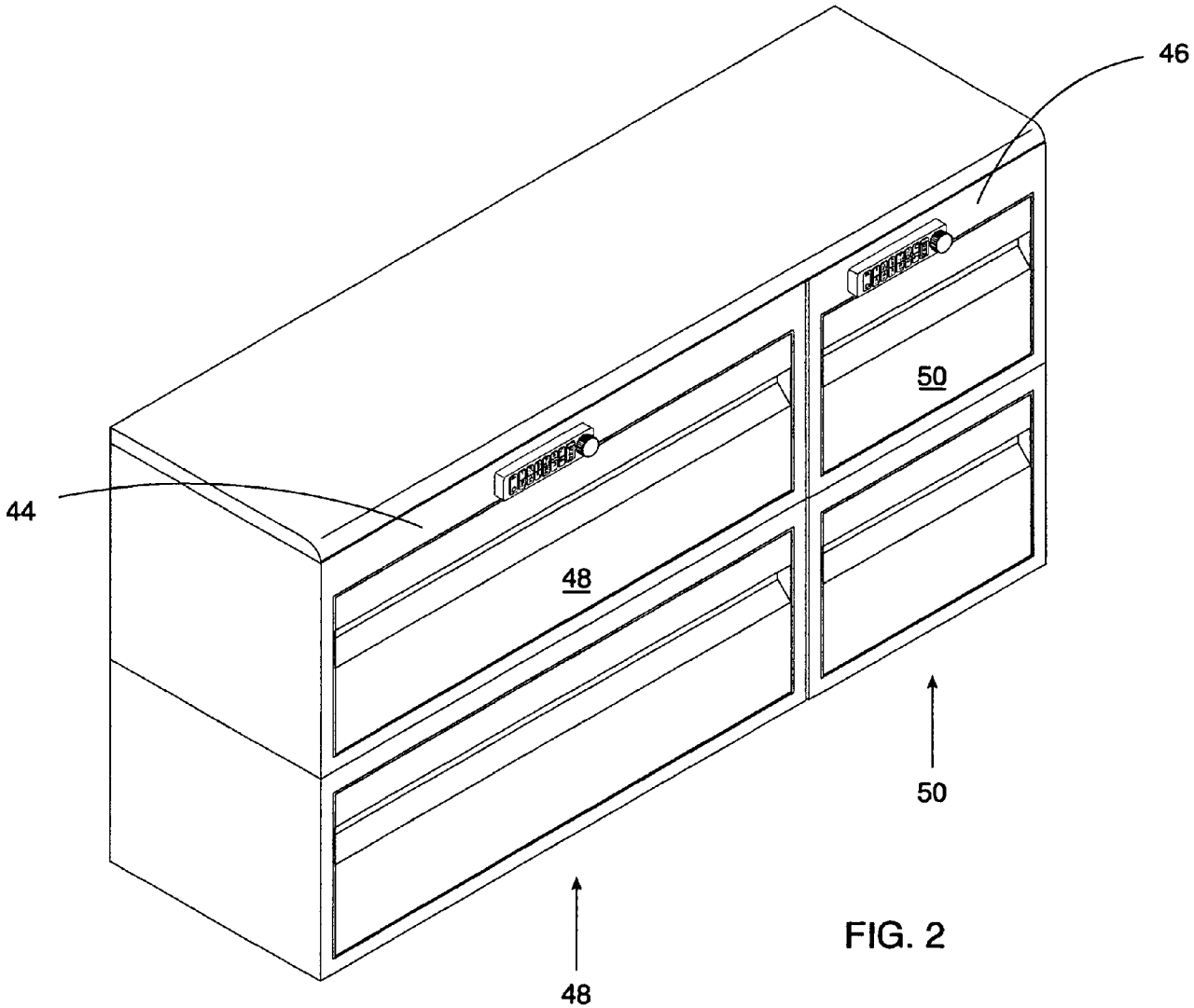
FIG. 2 is a view showing the device on a metal file cabinet.

FIG. 5 shows the cam 30, which can be in a bent offset shape as shown or can be any other desired configuration (a multiplicity of different cam shapes are available), engaged in a slot 36 in a structure 38 adjacent to a panel 40 to which the cam lock device is secured, via a nut or threaded ring 42. A flat 43 on the cylinder 26 matches the D configuration, or two opposed such flats can be included. Thus, the panel 40 may be a drawer to be pulled outwardly from the structure 38 when the lock is unlocked, or a door or cabinet or access panel. Similarly the lock device 10 can be installed in a panel of a fixed structure, such as the two locks shown as secured to the top margin areas of 44 and 46 in two adjacent banks of file drawers or file cabinets 48 and 50 in FIG. 2. In that case a cam can engage downwardly against a ledge or into a slot in the adjacent file drawer 52 or 54 when locked, preventing the pulling out of a drawer, or a more complex mechanical arrangement can be included, typical of such lateral file cabinets, whereby the lock either holds a locking mechanism in place for both drawers, or the locking of the top drawer effects the locking of the lower drawer as well, through a well-known form of mechanical interlinkage.

Figure 1A:
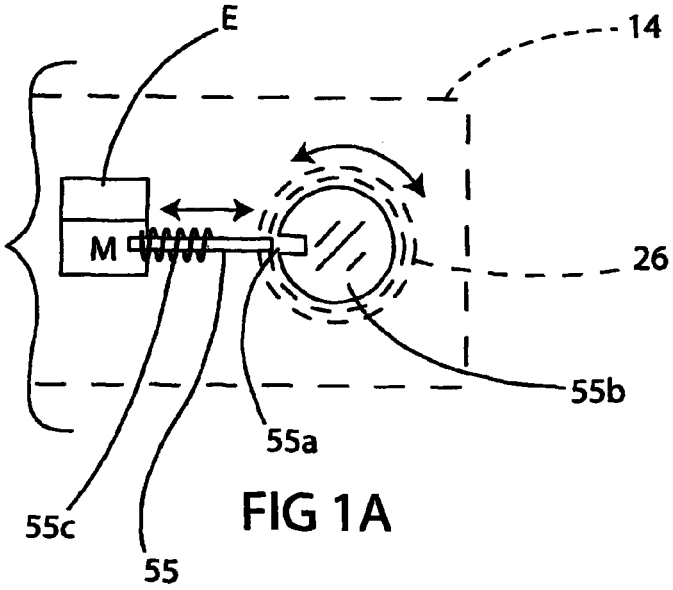
FIG. 1A is a schematic view showing a feature internal to the cam lock.

In a simple cam lock arrangement such as shown in FIGS. 3, 4 and 5, and referring to the simplified schematic view of FIG. 1A, the electronics (not shown but indicated at E in FIG. 1A) within the lock housing 14 can include or be connected to a slidable pin 55 driven by an electrically operated device, i.e. a solenoid or miniature motor M, for engaging the pin with a notch 55*a* in the internal rotatable member 55*b* leading from the handle or knob 12 to the rear-extending bolt 32, to prevent rotation. The pin may be urged toward the notch by a spring 55*c*. The electronics can be similar to those disclosed in any of the above patents incorporated herein by reference. PIN code actuated electronics are well known to those skilled in the art, and, when an appropriate code is entered using the keypad, the electronics will connect power to the motor or solenoid, or other electronic device to momentarily retract the blocking pin from such a notch in the rotatable member. If a solenoid is used it is biased to be normally urged into engagement with the notch whenever the notch is located in the appropriate position. If desired the lock can be set up to simply leave the notch out of contact with the biased pin when the knob has been rotated to unlock the cam lock device. The drawer or door or panel can thus be left with the lock in this state during working hours or during any period desired, until the user wishes to secure the drawer or door again. At that point, the user rotates the knob or handle until a "click" is felt, when the pin has re-engaged in the notch to lock the knob against further turning. A motor can also operate the pin with spring linkage.

An alternative arrangement is to have the cam lock cylinder unit define two different positions in which its movement is blocked. In this case, two notches (not shown, but second notch similar to 55*a* in FIG. 1A but at different rotational position) are provided in the internal rotatable member, one for locking the door or drawer and one for holding the knob and cam in a fully unlocked position, and in this situation a code must be entered in order to return the lock to the locked position.

Figure 4A:
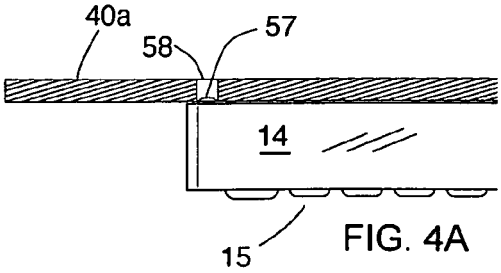

Although the cam lock device 10 can be securely retained on a door front panel or metal file cabinet panel or other door, drawer or access panel using the threaded cam lock cylinder unit 26 with the tightened nut 42 and the registry provided by the D or double D-shaped cam lock cylinder and opening typical of cam locks (see flat 43 shown in FIGS. 4 and 5), the installation may include an attachment at the other end of the lock housing, i.e. the end opposite where the handle or knob 12 is located (left side in FIG. 3). In FIG. 4 is shown a machine screw 56 that passes through a hole 58 in the panel 40*a*, tightened into a threaded opening in the housing 14. This will require drilling of a small hole, approximately ⅛ inch diameter, through the panel. Alternatively, the back of the housing 14 can simply have a nipple 57 that extends into the hole 58 (as indicated in FIG. 4A), or a hooked nipple, generally L-shaped, which is extended such that the leg of the L-shape goes through the hole to the back of the panel, then the housing is pivoted down against the panel until the cam lock cylinder unit 26 passes through the cam lock hole in the cabinet or panel.

An important feature of the invention is that the keypad-operated electronic cam lock device 10 includes no housing or electronic components at the inside of a door or drawer or panel. The only structure of the lock device extending into the interior or back side of the panel on which attached is the cam lock cylinder unit 26 and, optionally, a threaded fastener or machine bolt 56. This makes the unit of the invention compatible with situations in which nearly all cam locks are used, since those simple prior art key-operated devices typically comprise a rotatable plug for receiving the mechanical key, a cam lock cylinder shell with a front face plate, and a tail on the plug which has the cam affixed to the tail. Access can be difficult at the inside of a cabinet, and the avoidance of any inner housing or electronics (such as included in the some of the locker locks disclosed in the patents referenced above) is an important feature.

Figure 24:
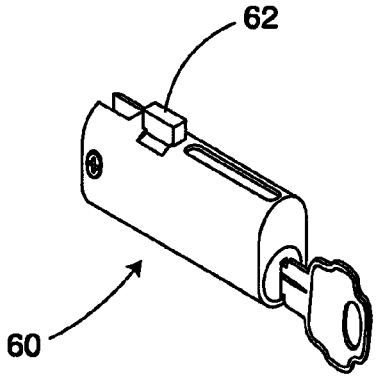
FIG. 24 (PRIOR ART)
FIG. 24 shows a typical prior art oval shaped plunger lock.
Figure 25:
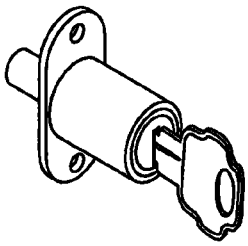
FIG. 25 (PRIOR ART)
FIG. 25 shows a typical prior art round shaped plunger lock.

Although a plunger type lock of the type often included on multiple-drawer file cabinets is not illustrated in the drawings, the invention applies to this type of lock as well. In that case the rotatable handle 12 on the lock unit 10 is replaced with a spring plunger unit with rotatable core, similar to a typical key-operated spring plunger unit such as the unit 60 shown in FIG. 24; the internal mechanism for holding the core against rotation can be similar to that described above, that is, an electrically operated blocking pin will release the rotatable core and handle 12 and upon core rotation the plunger slide blocking device (62 in FIG. 24) will be retracted allowing the spring plunger unit to release out by action of a spring thus opening the drawers. The side of the sliding plunger unit can be slotted to allow the electrically operated blocking pin to enter a channel in the side of the rotatable core, to hold the core against rotation when locked.

As mentioned above, instead of a solenoid operating the blocking pin operating in the lock housing 14, a miniature motor can be used. Such miniature motors require very small current and can be used to implement the extension or retraction of the pin that blocks the handle 12 or other device from being manipulated. The term electrically operated device includes a solenoid or miniature motor or other appropriate electric device.

Figure 6:
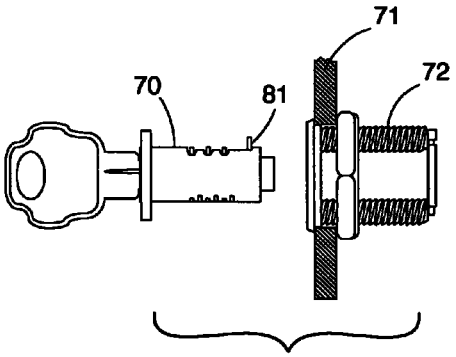
FIG. 6 (PRIOR ART)
FIGS. 6 and 6A show a typical cam lock shell mounted on a door with its plug being inserted.
Figure 6A:
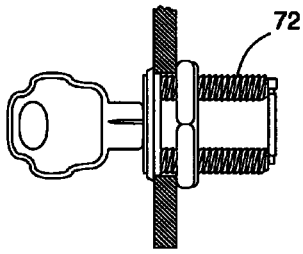
FIG. 6A (PRIOR ART)
Figure 7:
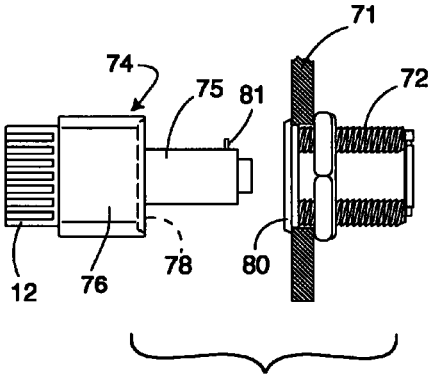
FIGS. 7 and 7A show the same configuration shown in FIGS. 6-6A replaced by the plug of the current invention.
Figure 7A:
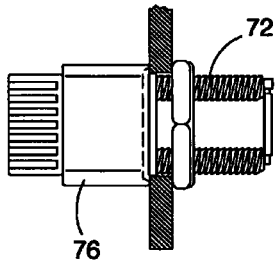

FIGS. 6-6A and 7-7A show a typical cam lock shell mounted on a door, with the plug 70 shown removed in FIG. 6 and inserted into the shell 72 in FIG. 6A to form the cylinder unit; and replacement by an electronic lock 74 with cylinder plug 75, retrofitted into the shell 72 in accordance with the invention (FIGS. 7 and 7A). The plug 75 is a "blank" plug that will operate the lock when installed via a retainer clip or pin 81, with the electronics to control access. In FIG. 7 the electronics housing 76 has a recess 78 shown in dashed lines, surrounding the extending plug 75, for the purpose of accommodating the slightly protruding face 80 of the cylinder shell 72 as installed in the door or drawer 71. Many of the cam locks used in furniture do have this type of front loaded plug which can also be removed for service and rekeying purposes.

Figure 8:
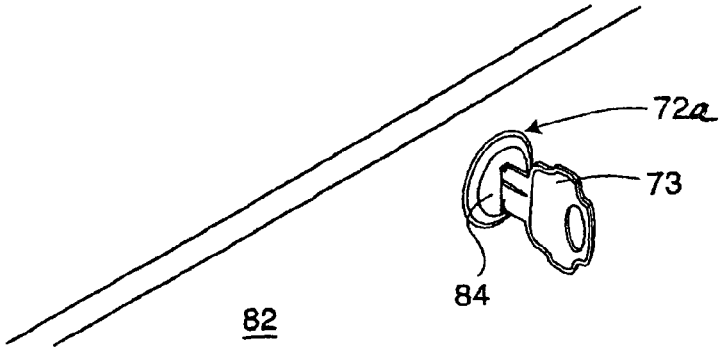
FIG. 8 (PRIOR ART)
FIGS. 8, 8A and 8B are perspective views showing replacement of an existing key operated cam lock cylinder plug with the current invention.
Figure 8A:
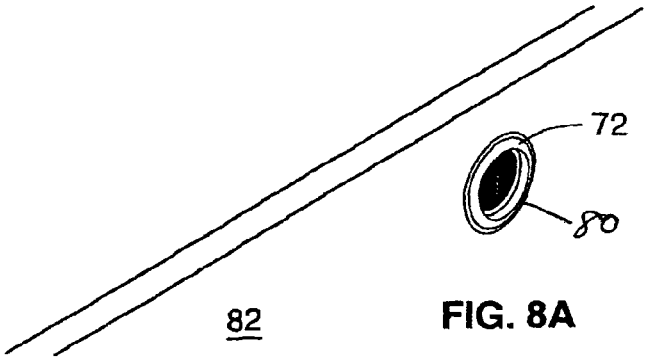
Figure 8B:
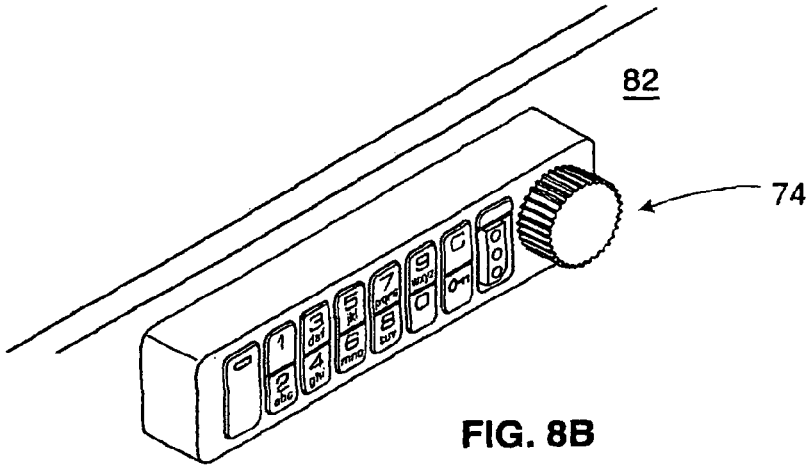

FIGS. 8, 8A and 8B show another door or drawer front 82 as fitted with a conventional cam lock or cabinet lock having a cylinder shell 72 such as shown in FIGS. 6 and 7. FIG. 8 shows the prior art lock 72*a* with a key 73 extending into a cam lock plug 84, while FIG. 8A shows the plug removed, revealing only the face plate 80 of the cam lock/cabinet lock cylinder 72. FIG. 8B shows the electronic lock 74 of the invention as installed into the opening defined by the lock cylinder 80 in door or drawer front 82. The lock 74 preferably has the same operational features as the lock described above with respect to FIGS. 1-5, the difference being that the plug 75 (FIG. 7) extends back from this unit, for fitting or retrofitting into an existing cylinder 72 that previously has had a conventional plug and key.

As is known by those skilled in the art, the prior art current plugs 70, 75 can be removed from the cylinder shell 72. This can be done by access to the spring loaded wafer or retainer clip 81. Access to this spring loaded retention device is restricted as is well known in the art.

Figure 9:
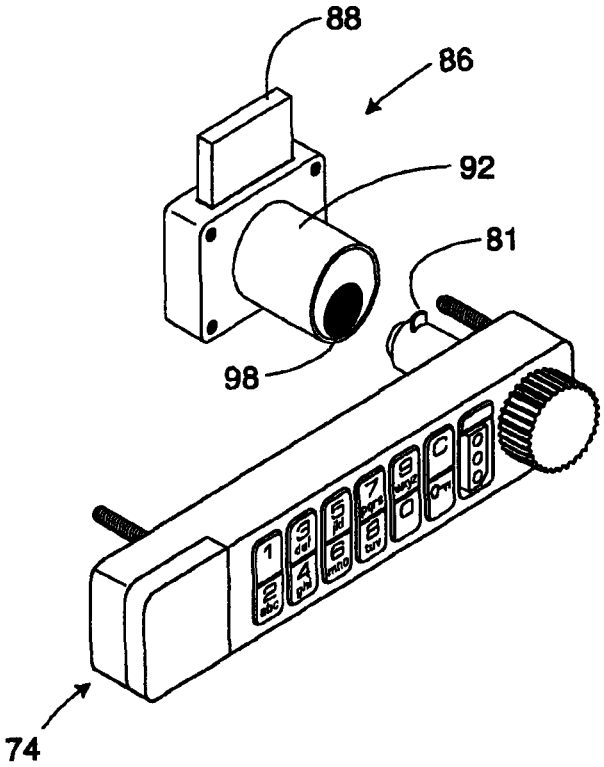
FIG. 9 is a perspective view showing the current invention with matching plug being applied to a cabinet lock with a bolt.
Figure 26:
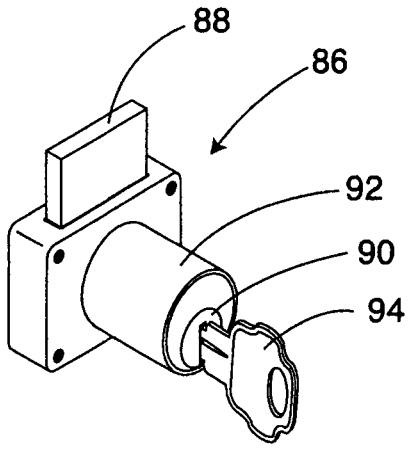
FIG. 26 (PRIOR ART)
FIG. 26 shows a typical prior art cabinet lock with bolt.
Figure 27:
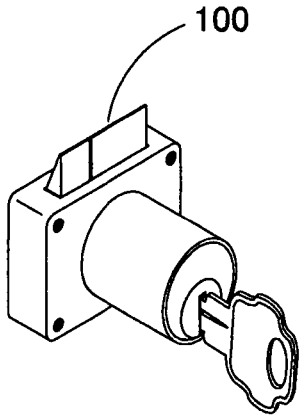
FIG. 27 (PRIOR ART)
FIG. 27 shows a typical prior art cabinet lock with spring loaded latch or deadlatch.
Figure 28:
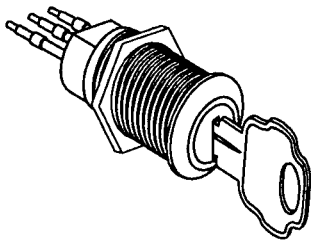
FIG. 28 (PRIOR ART)
FIG. 28 shows a typical prior art switch lock.
Figure 29:
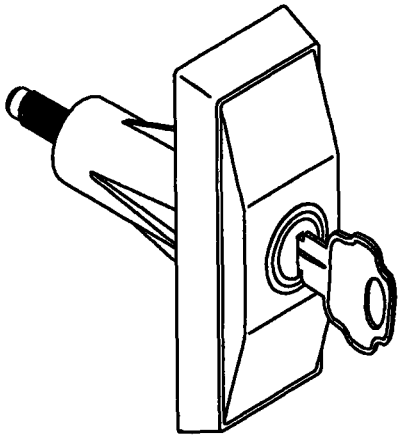
FIG. 29 (PRIOR ART)
FIG. 29 shows a typical prior art T handle screw type lock.
Figure 30:
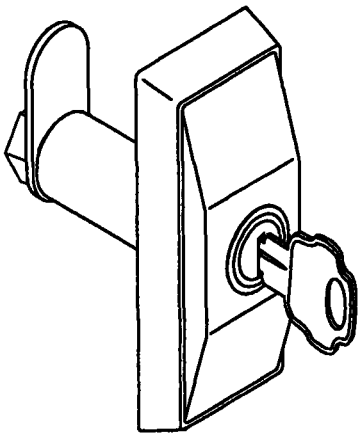
FIG. 30 (PRIOR ART)
FIG. 30 shows a typical prior art T handle cam type lock.

FIGS. 9-12, as well as the prior art views of FIGS. 26 and 27 all relate to another application of the invention. FIG. 9 shows an electronic lock unit 74 according to the invention in position to be assembled into an existing cabinet lock 86 of conventional design, the cabinet lock including an extendable/retractable bolt 88 which extends or retracts in response to, in the case of the prior art as shown in FIG. 26, rotation of a cylinder plug 90 that is positioned for rotation in the cabinet lock cylinder shell 92, and accessed by a key 94. The cylinder shell 92 extends through a door, drawer or other wall 96 as shown in the side elevation view of FIG. 11. Thus, in this type of lock there is no protruding face plate on the cylinder shell; the unit 86 is secured from the back, preferably via screws.

The exploded view of FIG. 9 shows that the unit 74 of the invention is simply inserted into the lock's plug opening 98, such that the plug 75 of the new unit goes into the hole 98 and refits the lock 86 just as the keyed plug was fit therein. Again, a spring loaded secure retainer 84 is included so that access is restricted.

Figure 10:
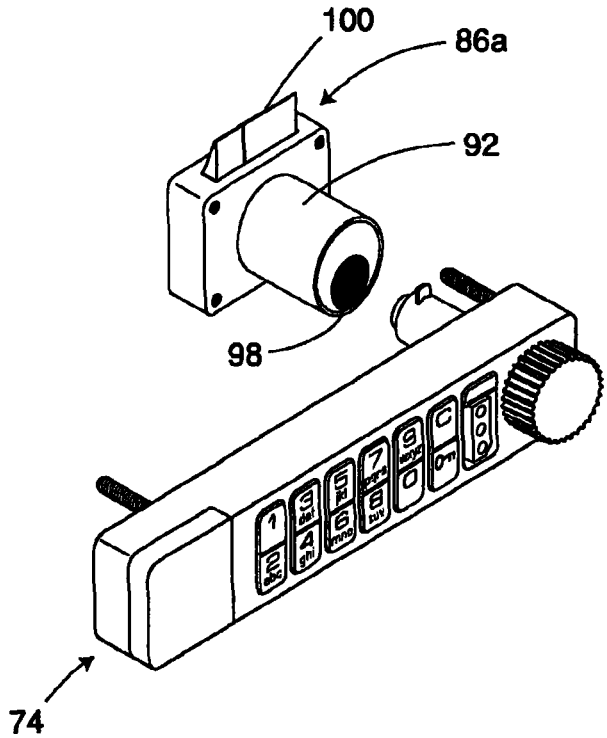
FIG. 10 is a perspective view showing the current invention with matching plug being applied to a cabinet lock with a spring loaded latch or deadlatch.
Figure 11:
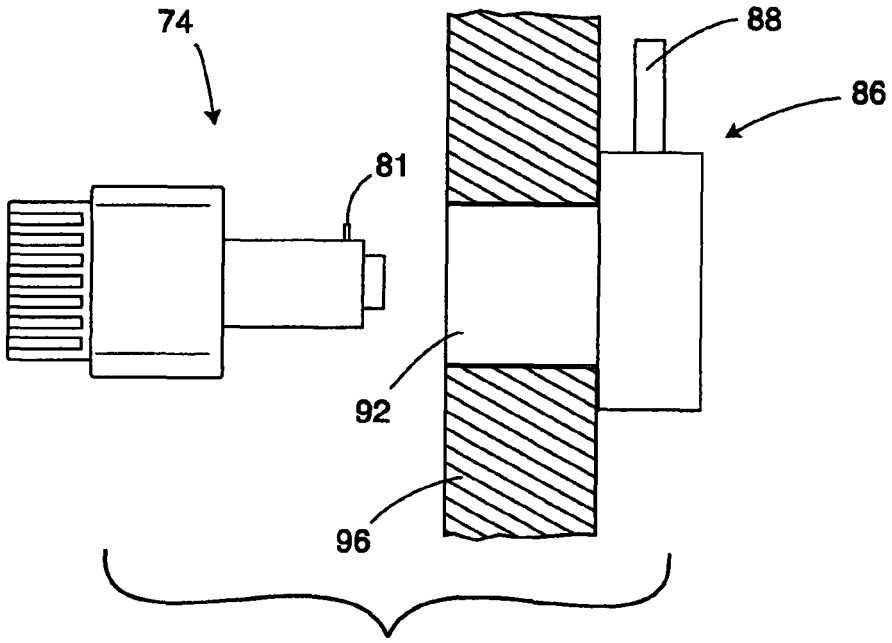
FIG. 11 shows a side view of what is shown in FIG. 9 being installed on a door or drawer.
Figure 12:
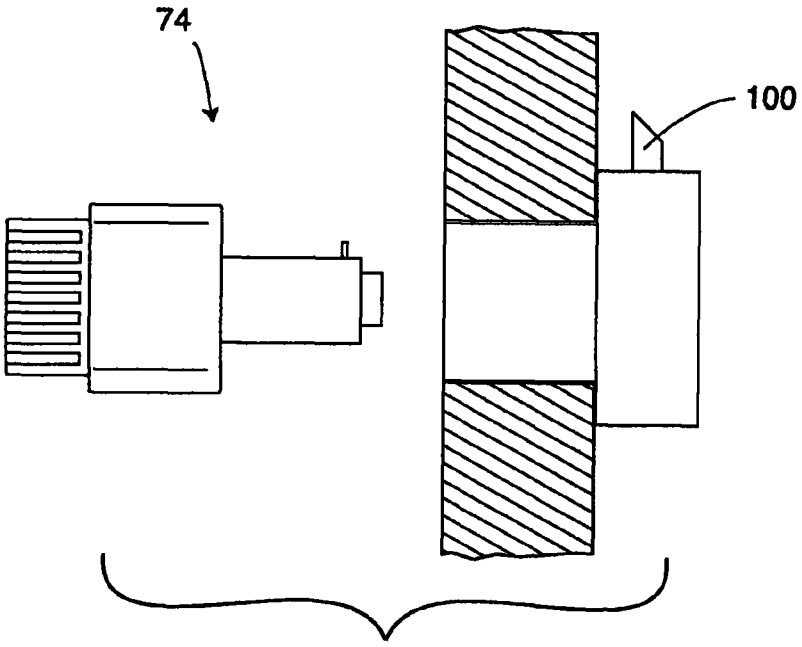
FIG. 12 shows a side view of what is shown in FIG. 10 being installed on a door or drawer.

FIGS. 10, 12 and 27 show a slightly different type of unit 86a wherein the locking device is a spring or dead latch 100 rather than a bolt such as shown in FIG. 9. The rest of the apparatus, including the unit 74 of the invention and the manner in which it is fitted into the lock to replace a keyed plug from the prior art, are the same.

FIGS. 13 through 21 show modified embodiments of the invention, particularly addressing situations in which an electronic lock of the invention will require components assembled from both inside and outside of a door, drawer, etc., as in the case of a cabinet lock, for example, as well as providing for a universal front electronic unit. The devices described with reference to FIGS. 9 through 12 are examples of two-part systems but they are principally for retrofit situations where in a "blank" plug extending from the electronic access device 74 of the invention is fitted into a cabinet lock type cylinder shell which is without a plug. In the variations shown in FIGS. 13 through 21, which should be viewed along with corresponding prior art views of FIGS. 23-30, the outside and inside components are connected together simply by a driver or extension of keyed shape, such as square, splined, D-shaped, flat, etc., since no plug or conventional cylinder with mechanical bittings or wafers is needed. Moreover, the embodiments of these drawings enable variations in depth to be accommodated, since a plug is not required to be seated to a prescribed depth in a cylinder shell.

Figure 13:
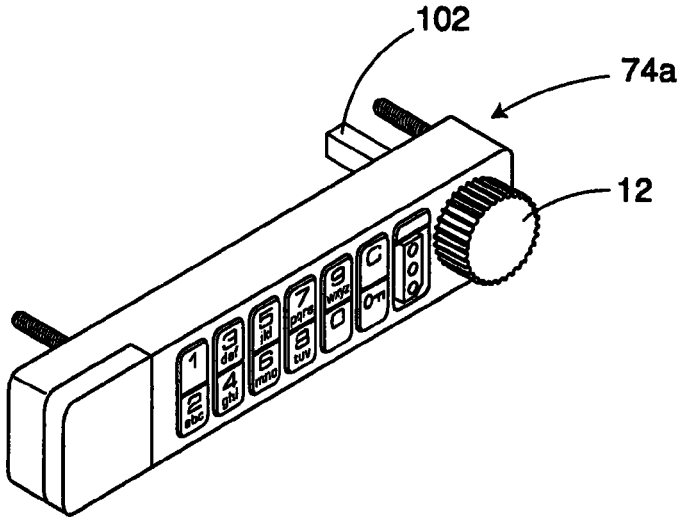
FIG. 13 shows a perspective view of electronic cam, cabinet or plunger lock of the invention with special shaped driver extending form the rear of the device.

FIG. 13 shows an electronic lock 74*a* of the invention, similar to the lock 74 described above in most respects and applicable to a cam, cabinet, plunger lock or similar lock, but with a specially shaped driver 102 extending back for engagement with a latching or locking device (lock unit) to be secured on the back side of a door, drawer, panel, etc. The driver 102 is operable by rotating the knob 12 as described previously, or a handle as shown and discussed below.

Figure 14:
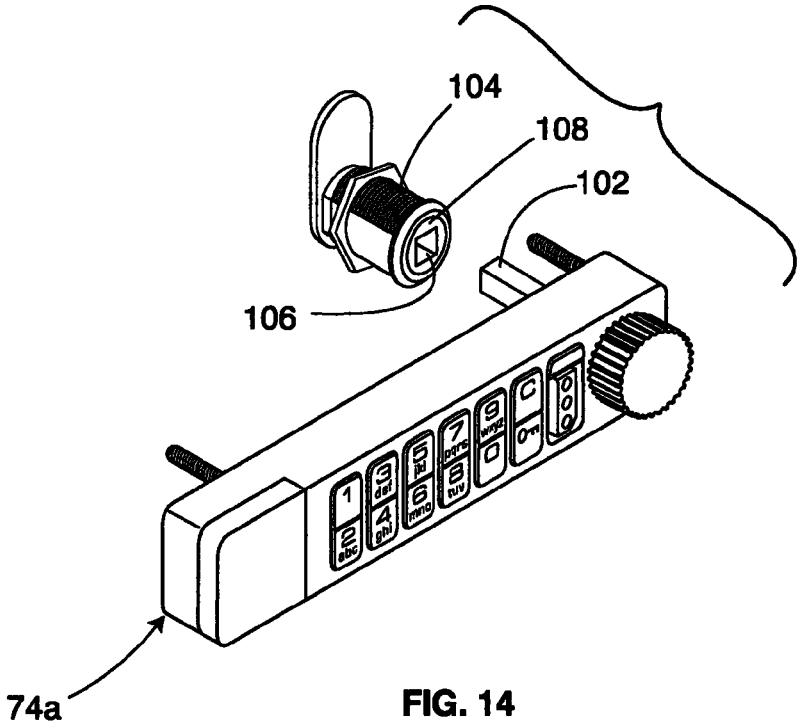
FIG. 14 shows the perspective view showing the current invention with special shaped driver being applied to a cam lock with matching plug.

FIG. 14 is an assembly view indicating the electronic lock unit 74*a*, with the lock driver 102 being essentially straight and perpendicular to the back of the unit and having a square cross sectional shape, and a cam lock or lock unit 104 with a similar specially shaped hole or receiving socket 106 in a rotatable plug 108. As noted above, it should be understood that any slide-in keyed cross-sectional shape can be employed, square being one example, but also including, flat, star-shaped, splined, D-shaped, etc. It can be seen, by comparison to FIGS. 3-5, that the embodiment of FIG. 14 is an alternative to that earlier-described embodiment.

Figure 15:
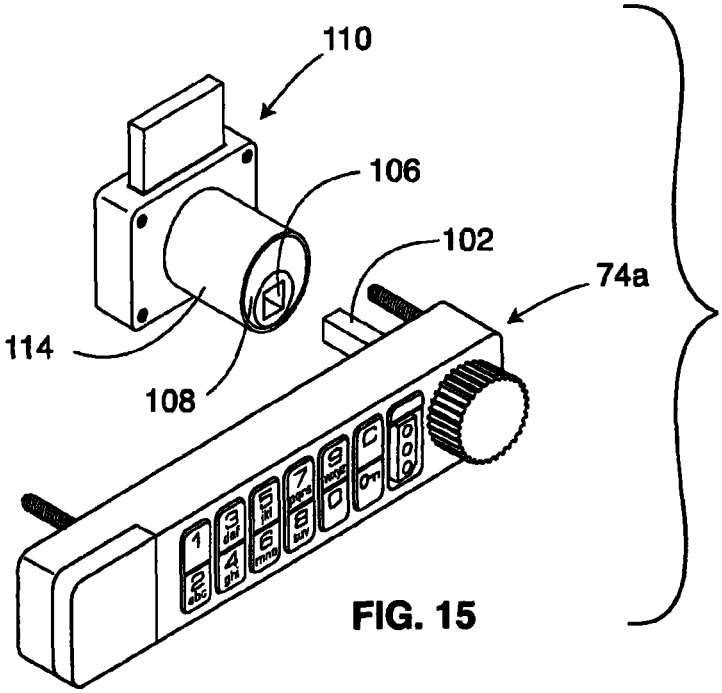
FIG. 15 shows the perspective view showing the current invention with special shaped driver being applied to a cabinet lock with bolt with matching plug.
Figure 16:
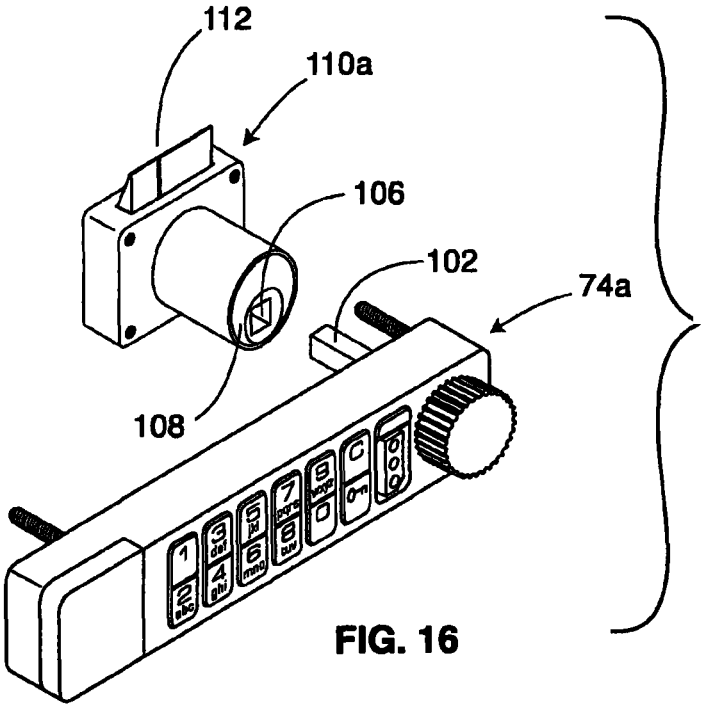
FIG. 16 shows the perspective view showing the current invention with special shaped driver being applied to a cabinet lock with latch or deadlatch with matching plug.

FIG. 15 shows the electronic lock unit 74*a*, with the specially shaped driver 102, positioned for assembly into a different type of lock, in this case a cabinet lock 110 of the type shown in FIG. 9 as the cabinet lock 86. In this case, of course, the special driver 102 extends into a complementary hole 106 in a rotatable plug 108 of the cabinet lock 110, rather than a blank plug extending into a plug opening as in the embodiment of FIG. 9. FIG. 16 shows a similar arrangement, with the cabinet lock 110*a* having a latch or dead latch 112 rather than a deadbolt.

The lock unit as shown in FIGS. 15 and 16 provides for more universal connections and standardization of lock components as compared to the earlier-described embodiments. A manufactured line of cabinets, drawers, doors, etc. can have prescribed types of lock units, with a cam lock, cabinet lock, plunger or other types as described below, and all can be arranged to be engaged with the electronic lock unit 74*a* of the invention. Depths due to different thicknesses of drawers, doors, etc. can be accommodated without providing a series of different shell depths for the shell 114 extending forward from the mechanical cam lock or cabinet lock or other lock unit. The electronic lock unit 74*a* can be universal for many different situations and applications.

Figure 17:
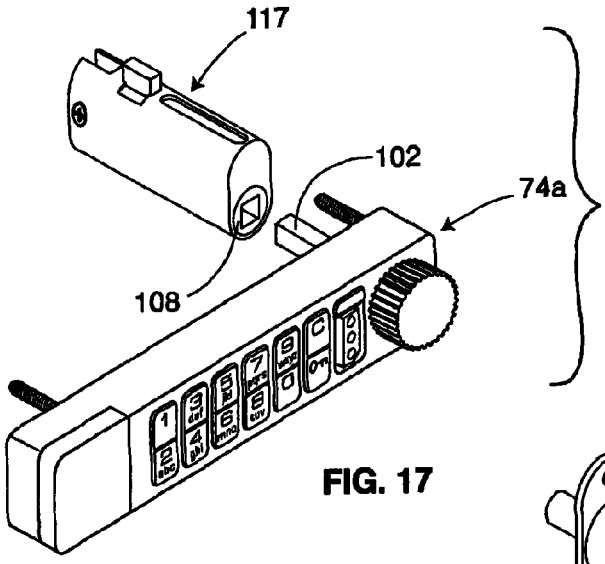
FIG. 17 shows the perspective view showing the current invention with special shaped driver being applied to an oval shaped plunger lock with matching plug.
Figure 18:
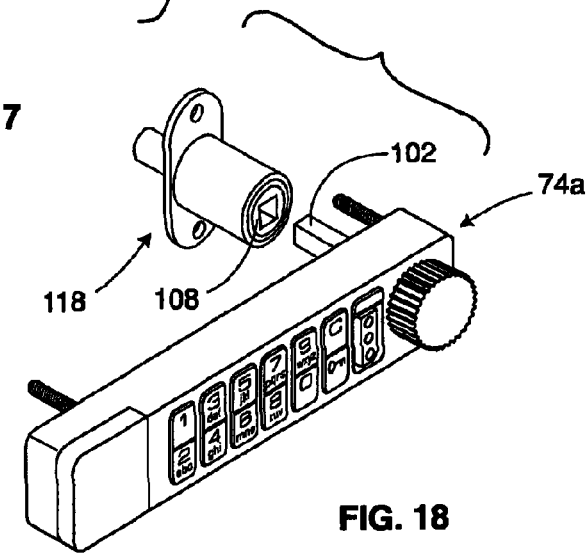
FIG. 18 shows the perspective view showing the current invention with special shaped driver being applied to a round shaped plunger lock with matching plug.
Figure 19:
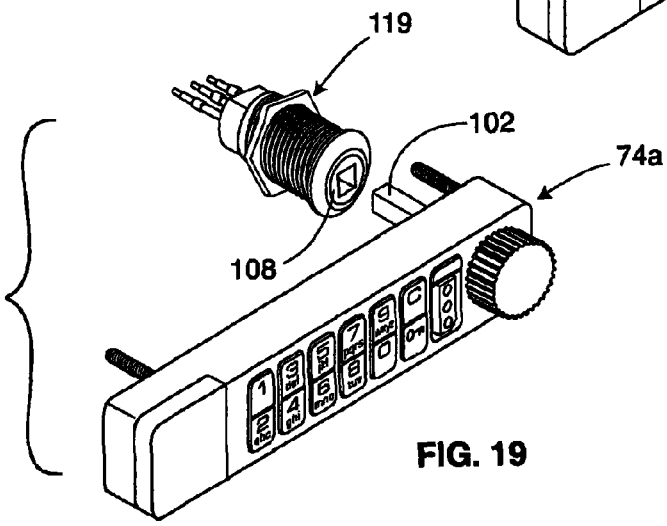
FIG. 19 shows the perspective view showing the current invention with special shaped driver being applied to a switch lock with matching plug.

FIG. 17 shows the same electronic lock unit 74*a* of the invention being applied to an oval shaped plunger lock 117, again with a matching rotatable plug 108 for receiving the special driver 102. FIG. 18 shows the lock unit 74*a* being applied to a round shaped plunger lock 118, again with a plug 108 matched to the driver 102 of the unit 74*a*. FIG. 19 shows the same electronic lock unit 74*a* being applied to an electric switch lock 119, again with a plug 108 matched to the driver 102.

Figure 20:
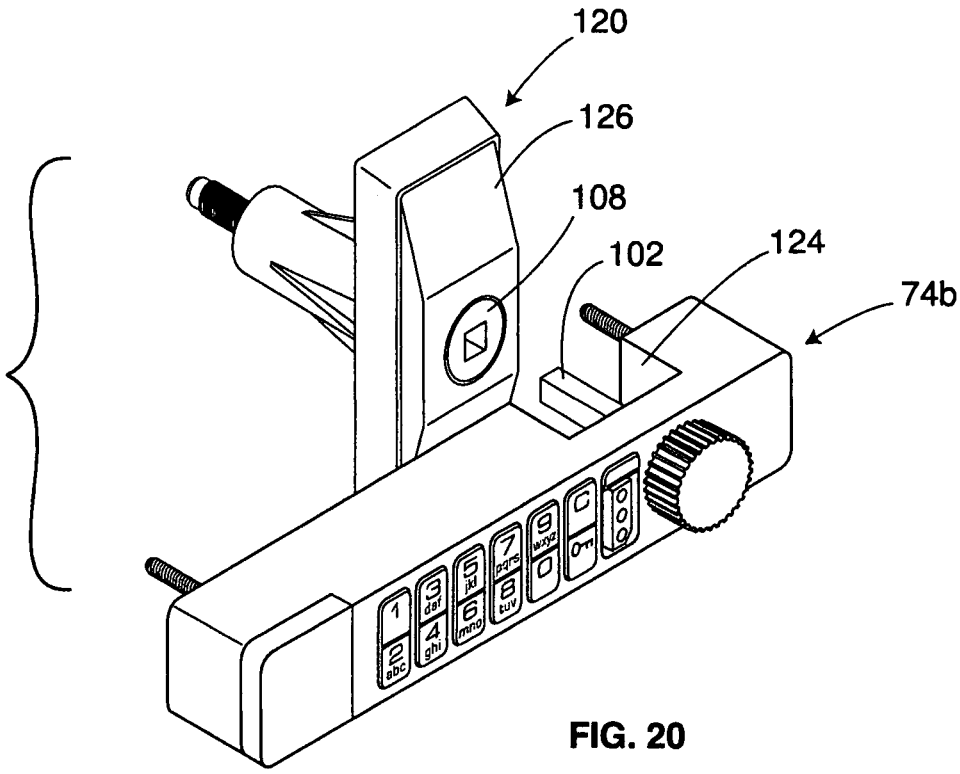
FIG. 20 shows the perspective view showing the current invention with special shaped driver being applied to a screw type T handle lock with matching plug.
Figure 21:
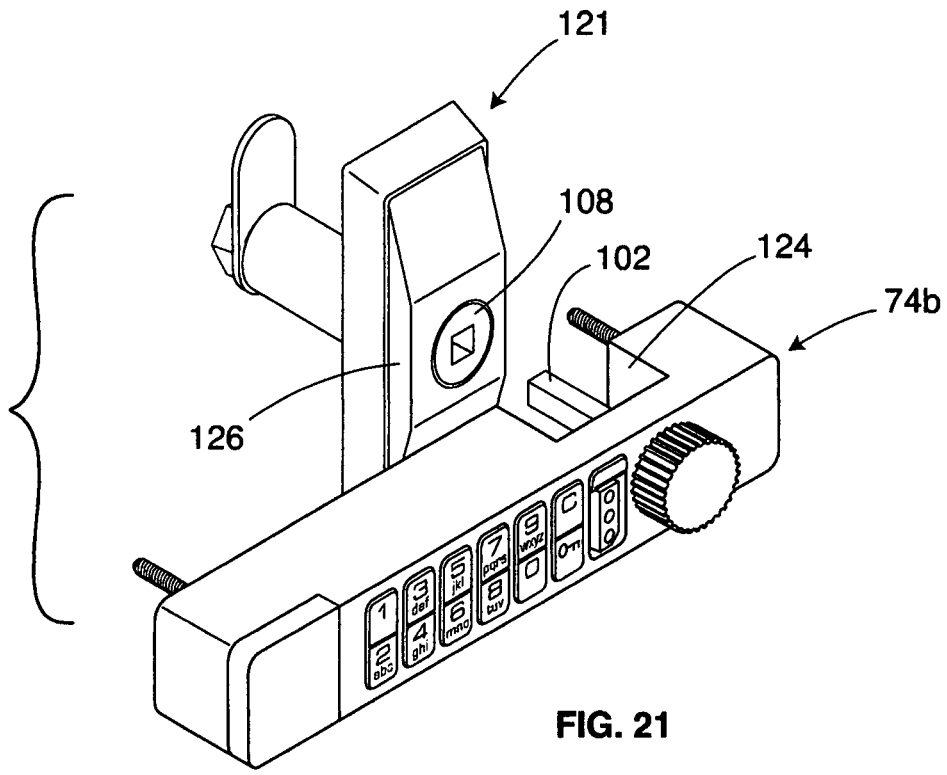
FIG. 21 shows the perspective view showing the current invention with special shaped driver being applied to a cam type T handle lock with matching plug.

FIG. 20 shows a modified electronic lock unit 74*b* being applied to a screw type T handle lock 120, again having a plug 108 matched to the special driver 102; FIG. 21 similarly shows the modified electronic lock unit 74*b* being applied to a cam type T handle lock 121, with the plug 108 and driver 102 matched. In both FIGS. 20 and 21, the back side of the lock unit 74*b* has a recess 124 that accommodates the outward extension 126 of the T handle lock, to the extent it protrudes out from the surface of the door, drawer, etc. When the electronic lock unit 74*b* is secured fast to the door, drawer or panel it appears integrated with the T handle lock 120 or 121. Note that in this case, the invention involves a lock unit 120, 121 that is assembled onto the front of the door or drawer, with the electronic unit 74*b* installed over it.

Figure 22:
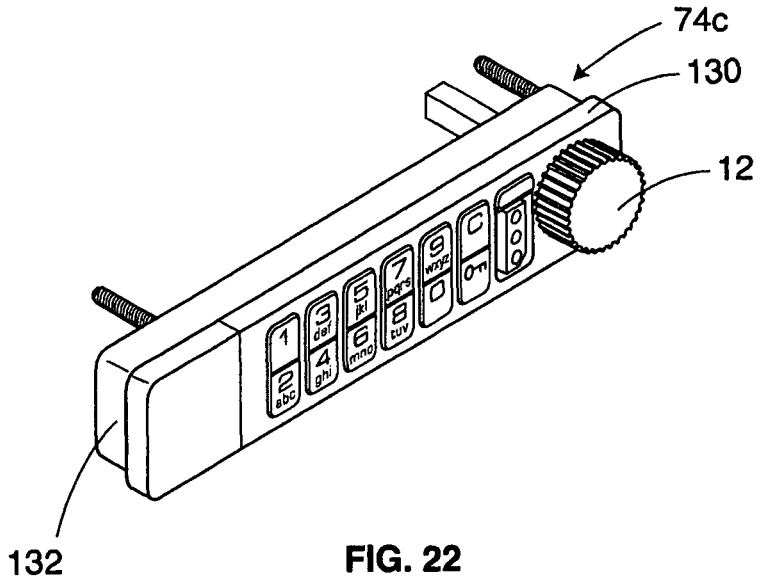
FIG. 22 Shows the perspective view of the current invention with a built in flange allowing recess mounting.
Figure 22A:
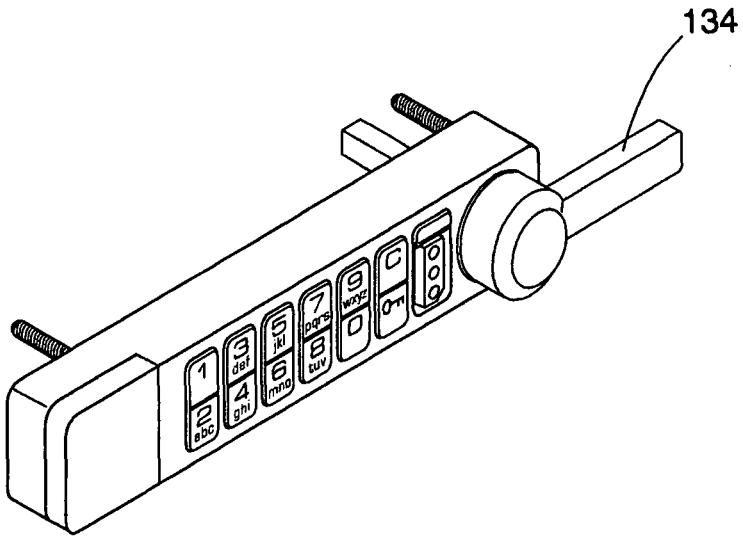
FIG. 22A shows a variation of FIG. 22 in which a lever replaces a knob, a variation applicable to all embodiments.

FIG. 22 shows a modified electronic lock unit 74*c* of the invention, in this case with an integral flange 130 designed to allow recess mounting of the base part 132 of the housing. FIG. 22A simply shows a variation, applicable to all embodiments, wherein the rotatable handle 12 is replaced with a lever 134, which may be needed for handicap access or for other purposes as desired.

The term cam lock as used in the claims is intended to refer to a cam lock or cabinet lock, or a plunger lock or switch lock or T handle lock. Also, references to a knob or handle are to be taken as referring to any type of turning device provided to operate the cam lock manually. Further, reference to a panel of a door, cabinet or drawer is intended to refer to any access panel or a fixed panel from which an openable component is controlled.

Note also that although a keypad is shown in the preferred embodiment above, the lock can be operated by a keypad in combination with an electronic key (used at the contact connection 22), or the keypad can be eliminated in favor of an electronic key alone. The term electronic access device refers to either type of electronic access.

Also, the electronic lock housing 14 can be oriented vertically instead of horizontally, with keypad characters oriented 90° from what is shown. Further, the cam in the illustrated embodiment can be rotatable to various degrees to fit the application.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A cam lock on a door, cabinet or drawer of furniture that provides ingress and no egress without a mechanical key, comprising:

a housing containing electronics and having a keypad for entry of codes by a user, the housing being positioned on and affixed to a front side of a panel of said door, cabinet or drawer to which the cam lock is affixed, a cam lock cylinder unit extending from a back side of the housing, in a standard cam lock size, fitting a standard cam lock opening in the panel and extending therethrough, with a knob or handle on the housing for operating the cam lock manually without a mechanical key when permitted by the electronics, and a battery compartment containing one or more batteries connected for operating the electronics.

2. The cam lock of claim 1, wherein the housing includes power jump contacts accessible from the outside of the door, cabinet or drawer to supply power in the event of battery failure.

3. The cam lock of claim 2, wherein the contacts include contacts for receiving electronically a master code to open the cam lock, at the same time power is applied.

4. The cam lock of claim 1, including an internal pin in the housing, engageable with the lock cylinder unit to put the lock cylinder unit in locked mode when the pin engages in a notch or recess in a movable member of the lock cylinder unit, and the electronics including means operably connected to retract the pin for unlocking the lock.

5. The cam lock of claim 1, including a blocking device within the housing, engageable with the cam lock cylinder unit so as to permit movement of a movable member within the lock cylinder unit only when the lock is in an unlocked mode.

6. The cam lock of claim 1, wherein the housing has dimensions of less than about 1" in height, about 3" to 5" in width and less than about ¾" in depth.

7. The cam lock of claim 6, wherein the housing is less than about ⅝" in depth.

8. The cam lock of claim 1, wherein the housing is elongated in shape and has the knob or handle toward one end and, toward an opposite end, a threaded bore connected to the back of the housing to receive a machine screw through a cabinet or door to which the cam lock is to be affixed.

9. The cam lock of claim 1, wherein the housing is elongated in shape and has the knob or handle toward one end and, at an opposite end, a nipple extending back from the back side of the housing, to extend into a hole formed in the door, cabinet or drawer to which the cam lock is to be affixed, and the lock cylinder unit having external threads, with a nut on the external threads for securing the lock to the door, cabinet or drawer.

10. The cam lock of claim 1, wherein all electronics and battery are contained in the housing, without any other housing or electronics to be positioned on the inner side of the door, cabinet or drawer to which the cam lock is to be affixed.

11. The cam lock of claim 1, wherein the housing containing electronics comprises the sole housing and sole electronics of the cam lock.

12. The cam lock of claim 1, wherein the cam lock cylinder unit includes a rotatable member for locking or unlocking the lock, the rotatable member having a single notch, and further including a locking pin in the housing which is extended into the notch or retracted by the electronics, the locking pin being spring-biased toward engagement in the single notch, such that when the cam lock is unlocked, the knob or handle can be manually turned to return the rotatable member back to the locking position for engagement by the pin.

13. The cam lock of claim 1, wherein the cam lock cylinder unit includes a rotatable member for locking or unlocking the lock, the rotatable member having two notches at different angular positions on the rotatable member, and a locking pin in the housing which is extended into the notch or retracted by the electronics, the locking pin being spring-biased toward engagement in the two notches, such that the cam lock is fixed by the pin in either the locked or unlocked position.

14. The cam lock of claim 1, including contacts accessible on the housing for receiving electronically a master code to open the cam lock, as well as for receiving jump power for a battery-low condition.

15. The cam lock of claim 1, wherein the keypad includes an enter key, and the electronics being configured such that a plurality of keys, then the enter key, must be pushed to properly enter a code to unlock the cam lock.

16. The cam lock of claim 1, wherein the batteries in the battery compartment comprise a plurality of batteries not larger than two AAA batteries.

17. The cam lock of claim 1, wherein the housing includes exposed contacts and wherein the electronics are programmable by an external device contacting the exposed contacts.

18. The cam lock of claim 1, wherein the housing, excluding the knob or handle, has a depth not greater than about ½" and a height less than about 1".

19. A cam lock on a door, cabinet or drawer of furniture that provides ingress and no egress without a mechanical key, comprising:

a compact housing containing electronics and having a keypad for entry of codes by a user, the housing being positioned on and affixed to a front side of a panel of said door, cabinet or drawer to which the cam lock is affixed, a cam lock plug unit extending from a back side of the housing, adapted to fit into a standard cam lock cylinder shell of a cam lock unit, said door, cabinet or drawer of said furniture having a standard cam lock cylinder shell installed in and extending through said panel, and said cam lock plug unit extending into the standard cam lock cylinder shell in the panel, the cam lock having a knob or handle on said housing for operating the cam lock manually without a mechanical key to rotate the cam lock plug unit when permitted by the electronics, and a battery compartment containing one or more batteries connected for operating the electronics.

20. The cam lock of claim 19, wherein the housing includes power jump contacts accessible from the outside of the door, cabinet or drawer to supply power in the event of battery failure.

21. The cam lock of claim 19, wherein the contacts include contacts for receiving electronically a master code to open the cam lock, at the same time power is applied.

22. The cam lock of claim 19, including an internal pin in the housing, engageable with the cam lock plug unit to put the cam lock plug unit in locked mode when the pin engages in a notch or recess in a movable member of the plug unit, and the electronics including a solenoid or motor operably connected to retract the pin for unlocking the lock.

23. The cam lock of claim 19, wherein the housing has dimensions of less than about 1" in height, about 3" to 5" in width and less than about ¾" in depth.

24. The cam lock of claim 19, wherein the housing is elongated in shape and has the knob or handle toward one end and, toward an opposite end, a machine screw post on the back of the housing to extend through a cabinet or door to which the cam lock is to be affixed.

25. The cam lock of claim 19, wherein the housing is elongated in shape and has the knob or handle toward one end and, at an opposite end, a nipple extending back from the back side of the housing, to extend into a hole formed in the door, cabinet or drawer to which the cam lock is to be affixed.

26. The cam lock of claim 19, wherein the compact housing containing electronics comprises the sole housing and sole electronics of the cam lock.

27. The cam lock of claim 19, wherein the cam lock plug unit includes a single notch, and further including a locking pin in the housing which is extended into the notch or retracted by the electronics, the locking pin being spring-biased toward engagement in the single notch, such that when the cam lock is unlocked, the knob or handle can be manually turned to return the plug unit back to the locking position for engagement by the pin.

28. The cam lock of claim 19, including contacts accessible on the housing for receiving electronically a master code to open the cam lock, as well as for receiving jump power for a battery-low condition.

29. The cam lock of claim 19, wherein the keypad includes an enter key, and the electronics being configured such that a plurality of keys, then the enter key, must be pushed to properly enter a code to unlock the cam lock.

30. The cam lock of claim 19, wherein the batteries in the battery compartment comprise a plurality of batteries not larger than two AAA batteries.

31. The cam lock of claim 19, wherein the housing includes exposed contacts and wherein the electronics are programmable by an external device contacting the exposed contacts.

32. The lock of claim 19, wherein the housing has a recess at the back side configured to fit over a protruding face of a lock cylinder installed in and extending through a panel.

33. The lock of claim 19, wherein the housing of the lock includes a front flange extending slightly over a remaining base part of the housing so as to provide for recess mounting of the housing with the base part recessed into an opening in the panel and the front flange engaged against the panel.

34. The lock of claim 1, wherein the knob or handle comprises a lever extending sufficiently for handicap access.

35. The lock of claim 19, wherein the knob or handle comprises a lever extending sufficiently for handicap access.

36. The cam lock of claim 6, wherein the furniture comprises a metal file cabinet, and wherein the cam lock is installed on a narrow margin area of the metal file cabinet.

37. The cam lock of claim 23, wherein the furniture comprises a metal file cabinet, and wherein the cam lock is installed on a narrow margin area of the metal file cabinet.

38. The cam lock of claim 1, wherein the furniture comprises a metal file cabinet, and wherein the cam lock is installed on a narrow margin area of the metal file cabinet.

39. The cam lock of claim 19, wherein the furniture comprises a metal file cabinet, and wherein the cam lock is installed on a narrow margin area of the metal file cabinet.

* * * * *